US010647111B2

(12) United States Patent
Kuramochi et al.

(10) Patent No.: US 10,647,111 B2
(45) Date of Patent: May 12, 2020

(54) LIQUID DROPLET FORMING DEVICE AND LIQUID DROPLET FORMING METHOD

(71) Applicants: Yuzuru Kuramochi, Kanagawa (JP); Daisuke Takagi, Kanagawa (JP); Satoshi Okano, Kanagawa (JP); Takahiko Matsumoto, Kanagawa (JP); Koichi Muramatsu, Kanagawa (JP); Satoshi Nakazawa, Kanagawa (JP); Ryuya Mashiko, Tokyo (JP)

(72) Inventors: Yuzuru Kuramochi, Kanagawa (JP); Daisuke Takagi, Kanagawa (JP); Satoshi Okano, Kanagawa (JP); Takahiko Matsumoto, Kanagawa (JP); Koichi Muramatsu, Kanagawa (JP); Satoshi Nakazawa, Kanagawa (JP); Ryuya Mashiko, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 16/294,969

(22) Filed: Mar. 7, 2019

(65) Prior Publication Data

US 2019/0283402 A1 Sep. 19, 2019

(30) Foreign Application Priority Data

Mar. 16, 2018 (JP) ..... 2018-049204
Dec. 26, 2018 (JP) ..... 2018-242311

(51) Int. Cl.
*B41J 2/045* (2006.01)
*B41J 2/14* (2006.01)

(52) U.S. Cl.
CPC ..... *B41J 2/04541* (2013.01); *B41J 2/04581* (2013.01); *B41J 2/04596* (2013.01); *B41J 2/14201* (2013.01); *B41J 2202/15* (2013.01)

(58) Field of Classification Search
CPC ..... B41J 2/04541; B41J 2/14201; B41J 2/04596; B41J 2/04581; B41J 2002/15
See application file for complete search history.

(56) References Cited

U.S. PATENT DOCUMENTS 6,127,082 A 10/2000 Humberstone et al.
6,394,582 B1 5/2002 Koeda
(Continued)

FOREIGN PATENT DOCUMENTS

JP 11-509774 8/1999
JP 2013-679 A 1/2013
(Continued)

OTHER PUBLICATIONS

Extended European Search Report dated Jul. 23, 2019, in Patent Application No. 19160867.8, 5 pages.

*Primary Examiner* — Sharon A. Polk
(74) *Attorney, Agent, or Firm* — Oblon, McClelland, Maier & Neustadt, L.L.P.

(57) ABSTRACT

Provided is a liquid droplet forming device including: a liquid container capable of containing a liquid; a membranous member disposed at a bottom of the liquid container and including a discharging hole; a deforming unit capable of deforming the membranous member; and a driving unit configured to drive the deforming unit by outputting a discharging signal for deforming the membranous member to discharge the liquid or a suppressing signal for suppressing residual vibration of the membranous member, wherein the suppressing signal is a signal based on natural vibration period $T_0$ of the membranous member, wherein an amplitude of the suppressing signal is lower than or equal to an amplitude of the discharging signal, and wherein interval time $T_i$ from when outputting of the discharging signal is ended until when outputting of the suppressing signal is
(Continued)

started satisfies a formula: $T_i=(m-½)\times T_O$, where m represents a positive integer.

6 Claims, 9 Drawing Sheets

(56) References Cited

U.S. PATENT DOCUMENTS

| | | | |
|---|---|---|---|
| 2010/0294793 | A1 | 11/2010 | Brown et al. |
| 2012/0143152 | A1 | 6/2012 | Hunter et al. |
| 2014/0151457 | A1 | 6/2014 | Wilkerson et al. |
| 2015/0251414 | A1 | 9/2015 | Araki |
| 2016/0175834 | A1 | 6/2016 | Seo et al. |
| 2016/0176191 | A1 | 6/2016 | Kuramochi et al. |

FOREIGN PATENT DOCUMENTS

| | | |
|---|---|---|
| JP | 2015-522444 | 8/2015 |
| JP | 5964826 | 7/2016 |
| JP | 2016-203157 | 12/2016 |
| JP | 2017-077197 | 4/2017 |

FIG. 12

| Initial filling amount (μL) | Optimum natural frequency (kHz) | Liquid amount range (μL) | Natural frequency range (kHz) |
|---|---|---|---|
| 50 | 10.0 | ±2 | ±1.0 |
| 60 | 9.0 | ±3 | ±1.5 |
| | | | |
| 110 | 5.5 | ±8 | ±9.0 |
| 120 | 5.0 | ±9 | ±10.0 |

LIQUID DROPLET FORMING DEVICE AND LIQUID DROPLET FORMING METHOD

CROSS-REFERENCE TO RELATED APPLICATIONS

The present application claims priority under 35 U.S.C. § 119 to Japanese Patent Application No. 2018-049204 filed Mar. 16, 2018 and Japanese Patent Application No. 2018-242311 filed Dec. 26, 2018. The contents of which are incorporated herein by reference in their entirety.

BACKGROUND OF THE INVENTION

Field of the Invention

The present disclosure relates to a liquid droplet forming device and a liquid droplet forming method.

Description of the Related Art

In recent years, along with the evolution of the stem cell technologies, techniques for discharging a plurality of cells by inkjet methods to form tissues have been being developed.

Examples of the inkjet methods include a piezoelectricity applying method of deforming a membranous member with a piezoelectric element to discharge the discharging target, a thermal method of generating bubbles with a heater to discharge the discharging target, and an electrostatic method of applying a tensile force to a liquid with an electrostatic attractive force to discharge the discharging target. Among these methods, the piezoelectricity applying method is suitable for use in forming liquid droplets of cell solutions because the piezoelectricity applying method is less likely to give damages to the cells due to heat or an electric field, compared with the other methods.

Various piezoelectricity applying-type liquid droplet forming devices useful for the stem cell technologies have been proposed (for example, see Japanese Translation of PCT International Application Publication No. JP-T-11-509774 and Japanese Unexamined Patent Application Publication No. 2017-77197).

SUMMARY OF THE INVENTION

According to one aspect of the present disclosure, a liquid droplet forming device of the present disclosure includes a liquid container configured to contain a liquid, a membranous member disposed at a bottom of the liquid container and including a discharging hole, a deforming unit configured to deform the membranous member, and a driving unit configured to drive the deforming unit by outputting a discharging signal for deforming the membranous member to discharge the liquid or a suppressing signal for suppressing residual vibration of the membranous member. The suppressing signal is a signal based on a natural vibration period $T_0$ of the membranous member. An amplitude of the suppressing signal is lower than or equal to an amplitude of the discharging signal. An interval time $T_i$ from when outputting of the discharging signal is ended until when outputting of the suppressing signal is started satisfies the following formula: $T_i=(m-½)\times T_0$, where m represents a positive integer.

BRIEF DESCRIPTION OF THE DRAWINGS

FIG. 12 is table data illustrating an example of parameters regarding an initial filling amount.

DESCRIPTION OF THE EMBODIMENTS (Liquid Droplet Forming Device)

A liquid droplet forming device of the present disclosure includes a liquid container configured to contain a liquid, a membranous member disposed at the bottom of the liquid container and including a discharging hole, a deforming unit configured to deform the membranous member, and a driving unit configured to drive the deforming unit by selectively outputting a discharging signal for deforming the membranous member or a suppressing signal for suppressing residual vibration of the membranous member, and further includes other units as needed.

The suppressing signal contains a natural vibration period $T_0$ of the membranous member. The amplitude of the suppressing signal is lower than or equal to the amplitude of the discharging signal. The interval time $T_i$ from when outputting of the discharging signal is ended until when outputting of the suppressing signal is started satisfies the following formula: $T_i=(m-½)\times T_0$, where m represents a positive integer.

The liquid droplet forming device of the present disclosure operates as a device configured to carry out a liquid droplet forming method of the present disclosure. That is, the liquid droplet forming device of the present disclosure is the same as carrying out the liquid droplet forming method of the present disclosure. Hence, the details of the liquid droplet forming method of the present disclosure will also be specified through description of the liquid droplet forming device of the present disclosure.

The present disclosure has an object to provide a liquid droplet forming device capable of quickly suppressing residual vibration of a membranous member.

The present disclosure can provide a liquid droplet forming device capable of quickly suppressing residual vibration of a membranous member.

The liquid droplet forming device of the present disclosure is based on the following finding. With existing liquid droplet forming devices, there is a problem that the number of times of discharging per unit time cannot be increased due to residual vibration of a membranous member after the membranous member is deformed to discharge a liquid, or there may be a case where the shape of the liquid droplets to be discharged is unstable.

Figure 1:
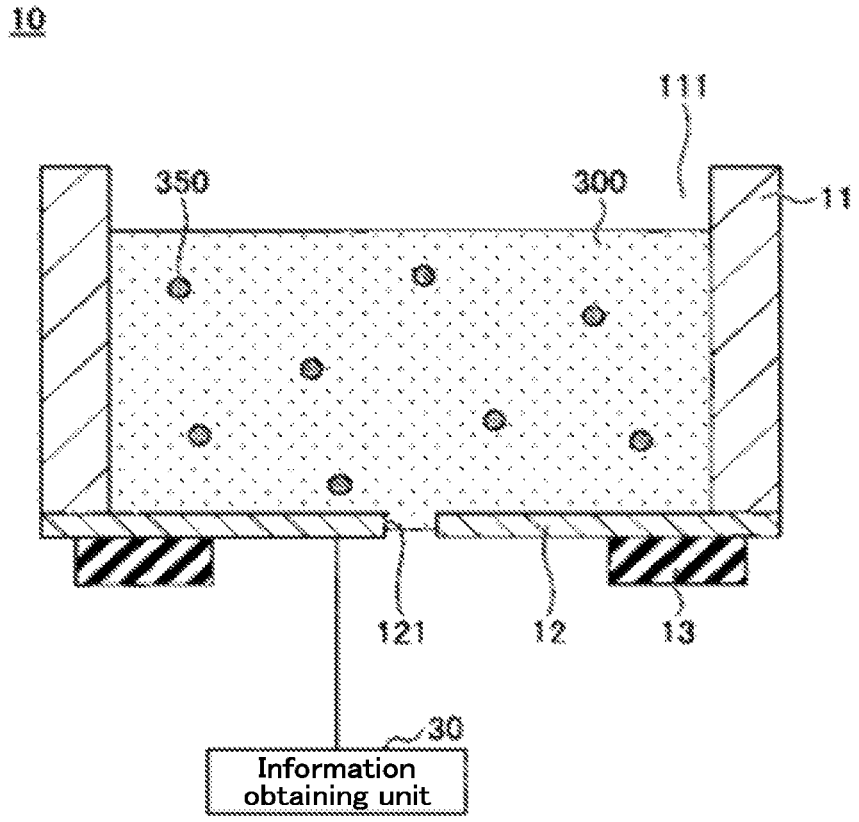
FIG. 1 is an exemplary diagram illustrating an example of an existing liquid droplet forming device.
Figure 2:
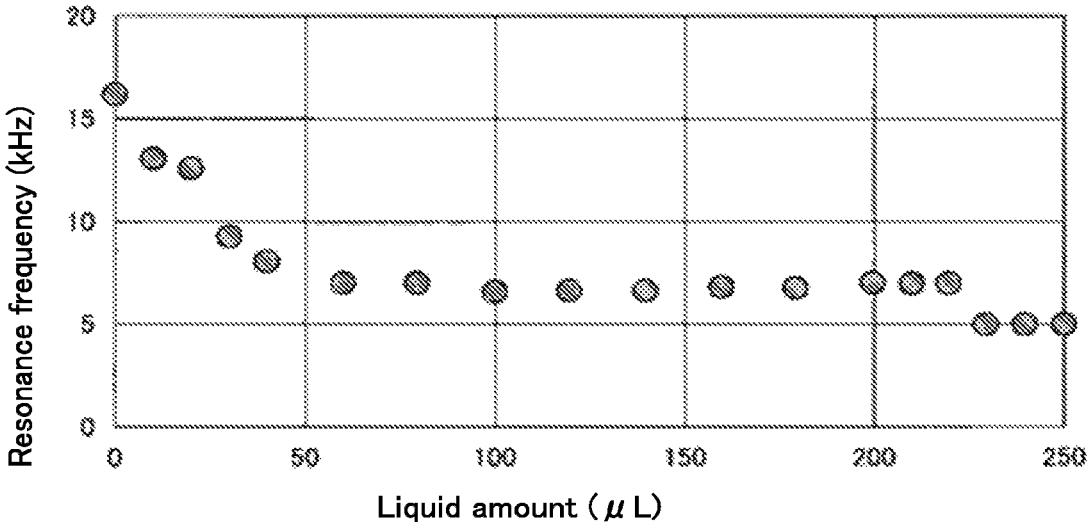
FIG. 2 is a graph plotting an example of a relationship between a liquid amount in a liquid chamber and a resonance frequency of a membrane in an existing liquid droplet forming device.

As illustrated in FIG. 1, Japanese Unexamined Patent Application Publication No. 2017-77197 describes a liquid droplet forming device 10 configured to excite a membrane 12 including a nozzle 121 with a piezoelectric element 13 to discharge a liquid droplet. The liquid droplet forming device 10 also includes an information obtaining unit 30 configured to sense a resonance frequency of the membrane 12 in order to set a control signal for driving the piezoelectric element 13. In such a liquid droplet forming device 10, the resonance frequency of the membrane changes in accordance with increase or decrease in the liquid amount in the liquid chamber 11, as plotted in FIG. 2. Specifically, it can be seen that the resonance frequency is stable in a certain liquid amount range and that the relationship between the resonance frequency and the liquid amount is not linear.

The liquid droplet forming device of the present disclosure is based on a finding that there is a case where the resonance frequency is stable in a certain liquid amount range.

The resonance frequency may also be referred to as "natural frequency" hereinafter.

In the liquid droplet forming device of the present disclosure, the suppressing signal is a signal based on a natural vibration period $T_0$ of the membranous member, the amplitude of the suppressing signal is set lower than or equal to the amplitude of the discharging signal so as not to generate unneeded vibration. Further, in the liquid droplet discharging device of the present disclosure, the interval time $T_i$ from when outputting of the discharging signal is ended until when outputting of the suppressing signal is started is set to satisfy the following formula: $T_i=(m-1/2)\times T_0$, in order to set the timing to output the suppressing signal at an antiphase of the residual vibration. Therefore, the liquid droplet forming device of the present disclosure can quickly suppress residual vibration of the membranous member and can hence increase the number of times of discharging per unit time. Furthermore, the liquid droplet forming device of the present disclosure can perform more minute control of the liquid droplet amount, because the liquid droplet forming device of the present disclosure can reduce occurrence of troubles due to residual vibration such as a satellite formed when a liquid droplet is split or a mist formed when a liquid droplet scatters minutely.

A mode for carrying out the present disclosure will be described below with reference to the drawings. The same components will be denoted by the same reference numerals throughout the drawings. Redundant description about the same components may be skipped.

First Embodiment

[Structure of Liquid Droplet Forming Device]

The liquid droplet forming device according to the first embodiment will be described.

Figure 3:
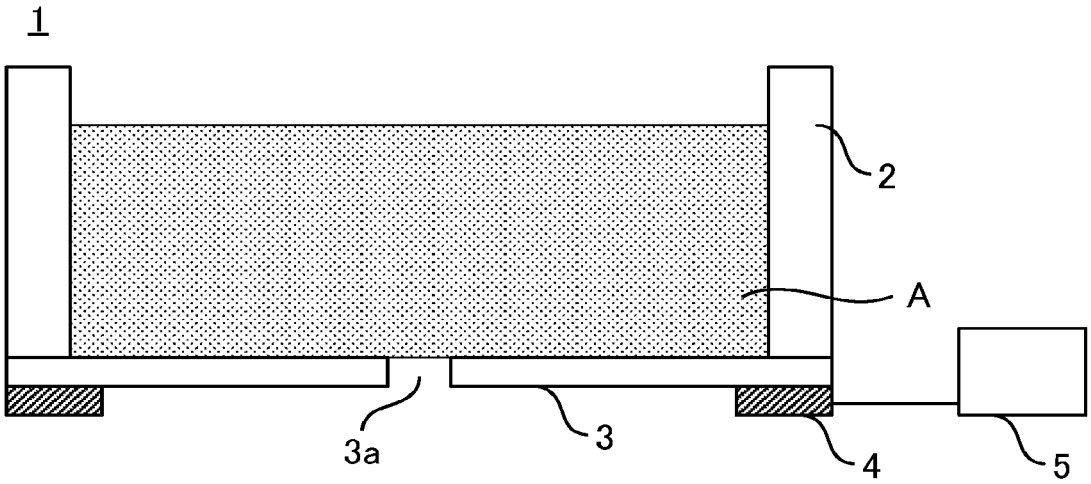
FIG. 3 is a cross-sectional view illustrating a liquid droplet forming device according to a first embodiment.

FIG. 3 is a cross-sectional view illustrating the liquid droplet forming device according to the first embodiment.

As illustrated in FIG. 3, the liquid droplet forming device 1 according to the first embodiment includes a liquid chamber 2 configured to contain a liquid, a membrane 3 in which a discharging hole (nozzle) 3*a* is formed, a piezoelectric element 4, and a driving unit 5 configured to output a driving signal to the piezoelectric element 4.

In the present embodiment, for expediency, a side of the liquid chamber 2 having the liquid surface is referred to as upper side, and a side of the liquid chamber 2 having the piezoelectric element 4 is referred to as lower side. Further, a surface of each portion at a side at which the liquid chamber 2 is present is referred to as upper surface, and a surface of each portion at a side at which the piezoelectric element 4 is present is referred to as lower surface.

The liquid chamber 2 includes the membrane 3 at the bottom, and can contain a liquid A.

The liquid A is not particularly limited and may be appropriately selected depending on the intended purpose.

Examples of the material of the liquid chamber 2 include metals, silicon, and ceramics.

The size of the liquid chamber 2 is not particularly limited and may be appropriately selected depending on the intended purpose.

The amount of the liquid A that can be contained in the liquid chamber 2 is not particularly limited, may be appropriately selected depending on the intended purpose, and may be from 1 microliter through 1 mL, and may be from 1 microliter through 50 microliters when the liquid A is a cell suspension in which cells are dispersed.

The membrane 3 is disposed as the bottom of the liquid chamber 2, and secured on the ends of the lower surface of the liquid chamber 2. The discharging hole 3*a*, which is a through hole, is formed in approximately the center of the membrane 3, and the liquid A contained in the liquid chamber 2 is discharged through the discharging hole 3*a* in the form of a liquid droplet D in response to deformation of the membrane 3.

The membrane 3 is deformed by the piezoelectric element 4.

In the present embodiment, a circular SUS plate having an average thickness of 40 micrometers and a diameter of 20 mm is used as the membrane 3.

The shape of the membrane 3 when seen in a plan view perspective is not particularly limited and may be appropriately selected depending on the intended purpose. Examples of the shape of the membrane 3 include a circular shape, an elliptic shape, and a quadrangular shape. A shape matching the shape of the bottom of the liquid chamber 2 is preferable.

The material of the membrane 3 is not particularly limited and may be appropriately selected depending on the intended purpose. Examples of the material of the membrane 3 include metallic materials, ceramic materials, and polymeric materials. A material having a certain degree of hardness is preferable. When the material of the membrane 3 has a certain degree of hardness, the membrane 3 does not easily undergo vibration, and vibration of the membrane 3 can be easily suppressed.

Examples of the metallic materials include stainless steel, nickel, and aluminum.

Examples of the ceramic materials include silicon dioxide, alumina, and zirconia.

In the present embodiment, the discharging hole 3*a* is formed in approximately the center of the membrane 3 in substantially a perfect circle shape.

The shape of the discharging hole 3*a* is not particularly limited and may be appropriately selected depending on the intended purpose. Examples of the shape of the discharging hole 3*a* include a perfect circle shape.

When the shape of the discharging hole 3*a* is a perfect circle shape, the diameter of the discharging hole 3*a* is not particularly limited, may be appropriately selected depending on the intended purpose, and is preferably 20 micrometers or greater but 200 micrometers or less. The diameter of the discharging hole 3*a* in the preferable range is advantageous in terms of stabilization of the shape of the liquid droplets to be discharged.

The piezoelectric element 4 is disposed at the lower surface side of the membrane 3. In the present embodiment, a bending-type ring piezo element (available from Noliac, CMBR03) is used as the piezoelectric element 4.

The shape of the piezoelectric element 4 is preferably a shape matching the shape of the membrane 3. For example, when the shape of the membrane 3 when seen in the plan view perspective is a circular shape, it is preferable to form the piezoelectric element 4 having an annular (ring-like) planar shape around the discharging hole 3*a*.

The piezoelectric element 4 has a structure obtained by providing the upper surface and the lower surface of a piezoelectric material with electrodes across which a voltage is to be applied. When a voltage is applied across the upper and lower electrodes of the piezoelectric element 4, a compressive stress is applied in the horizontal direction of the drawing sheet, making it possible for the membrane 3 to deform or vibrate.

Examples of the piezoelectric material include lead zirconate titanate, bismuth iron oxide, metal niobate, and barium titanate, and materials obtained by adding metals or different oxides to these materials.

In the present embodiment, the piezoelectric element 4 is configured to deform the membrane 3. However, this is non-limiting, and any other mode may be employed. In any other mode, for example, a material having a different coefficient of linear expansion from the coefficient of linear expansion of the membrane 3 may be pasted over the membrane 3, and may be heated to deform the membrane 3 utilizing the difference between the coefficients of linear expansion. In this mode, it is preferable to dispose a heater near the material having the different coefficient of linear expansion, and cause the membrane 3 to deform or vibrate in accordance with ON or OFF of the heater.

The driving unit 5 can output a discharging signal Pj to the piezoelectric element 4 as a driving signal. By outputting the discharging signal Pj to the piezoelectric element 4, the driving unit 5 can cause the membrane 3 to deform and discharge the liquid A contained in the liquid chamber 2 in the form of a liquid droplet D. Further, by causing the membrane 3 to deform by means of the discharging signal Pj set to a predetermined period, the driving unit 5 can cause the liquid to be discharged under resonant vibration of the membrane 3.

The driving unit 5 can output a suppressing signal Ps to the piezoelectric element 4 as a driving signal. By outputting the suppressing signal Ps to the piezoelectric element 4 after a liquid droplet D is discharged, the driving unit 5 can suppress residual vibration of the membrane 3. Therefore, the liquid droplet forming device 1 can suppress the residual vibration of the membrane 3 quickly without waiting for the residual vibration to decay naturally, and can hence increase the number of times of discharging per unit time. Furthermore, the liquid droplet forming device 1 can perform more minute control of the liquid droplet amount, because the liquid droplet forming device 1 can reduce occurrence of troubles due to the residual vibration such as a satellite formed when a liquid droplet is split or a mist formed when a liquid droplet scatters minutely.

[Liquid Droplet Forming Process (Operation) of Liquid Droplet Forming Device]

A process through which the liquid droplet forming device according to the first embodiment forms a liquid droplet will be described.

Figure 4:
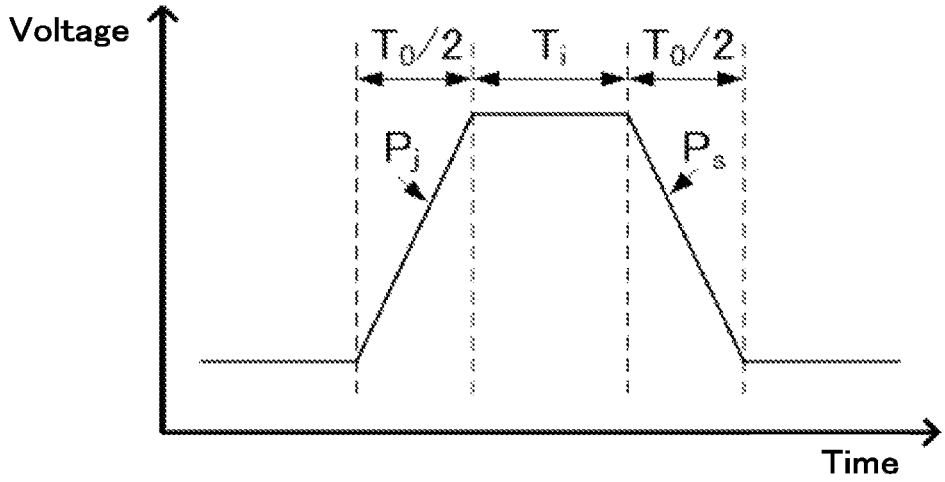
FIG. 4 is a graph plotting an example of a discharging signal and a suppressing signal.
Figure 5A:
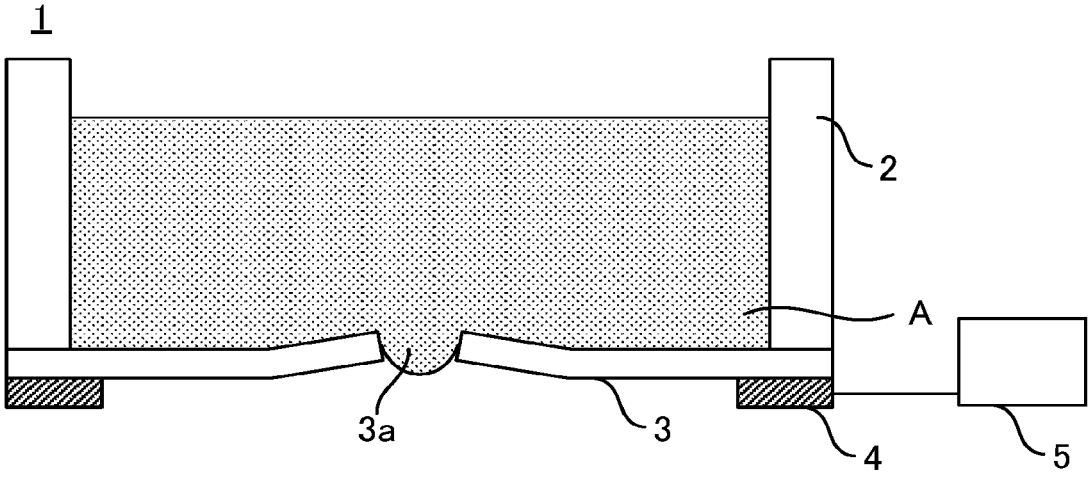
FIG. 5A is a view illustrating an operation of a liquid droplet forming device according to a first embodiment.
Figure 5B:
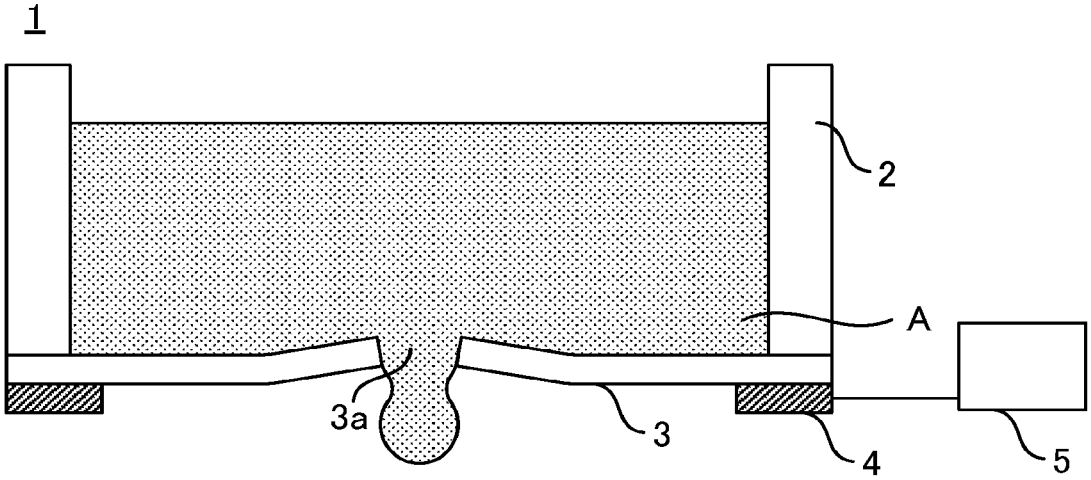
FIG. 5B is a view illustrating an operation of a liquid droplet forming device according to a first embodiment.
Figure 5C:
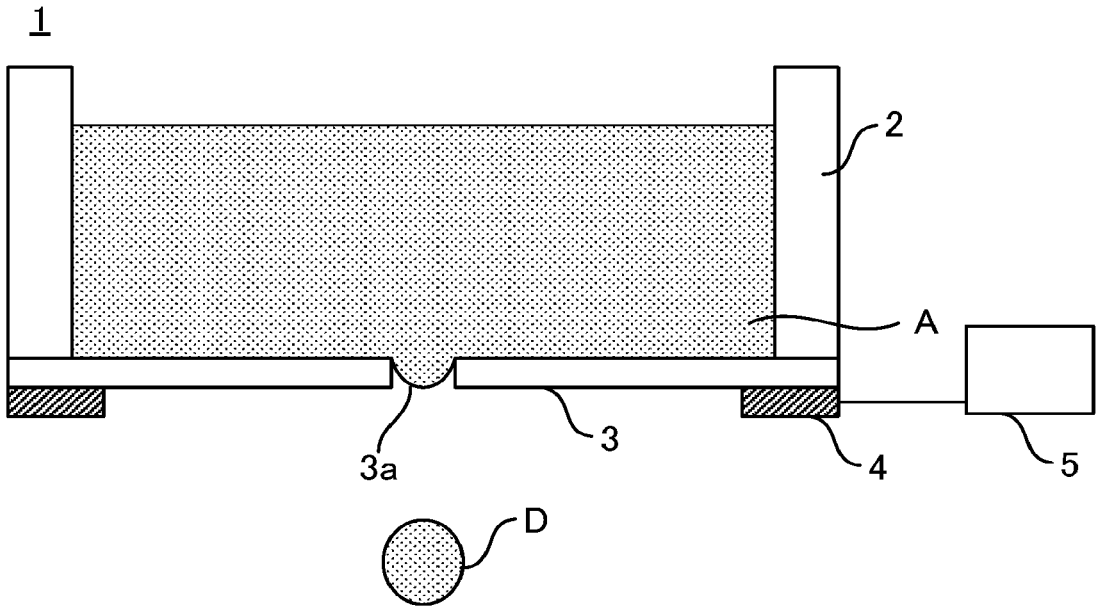
FIG. 5C is a view illustrating an operation of a liquid droplet forming device according to a first embodiment.

FIG. 4 is a graph plotting an example of the discharging signal and the suppressing signal. FIG. 5A to FIG. 5C are views illustrating an operation of the liquid droplet discharging device according to the first embodiment.

When the discharging signal Pj and the suppressing signal Ps plotted in FIG. 4 are output to the piezoelectric element 4, a liquid droplet D can be formed and residual vibration of the membrane 3 can be suppressed as well, as illustrated in FIG. 5A to FIG. 5C.

First, when the discharging signal Pj is output as plotted in FIG. 4, the membrane 3 rapidly deforms as illustrated in FIG. 5A to push out the liquid A contained in the liquid chamber 2 downwards through the discharging hole 3*a*.

The discharging signal $P_j$ is not particularly limited and may be appropriately selected depending on the intended purpose. As the discharging signal $P_j$, a signal based on the natural vibration period $T_0$ of the membrane 3 is preferable in terms of discharging the liquid A at a lower voltage by means of the membrane 3. In the present embodiment, by setting the time for which the discharging signal $P_j$ is output, i.e., the time for which the applied voltage is raised, to $T_0/2$, it is possible to discharge the liquid A at a lower voltage by means of the membrane 3.

The natural vibration period $T_0$ of the membrane 3 can be measured with, for example, a laser Doppler vibrometer (LV-1800, available from Ono Sokki Co., Ltd.).

Next, as plotted in FIG. 4, during a time for which a constant voltage is applied to the piezoelectric element 4, i.e., during the interval time $T_i$ from when outputting of the discharging signal $P_j$ is ended until when outputting of the suppressing signal $P_s$ is started, a liquid droplet D from the discharging hole 3*a* grows as illustrated in FIG. 5B. During this interval time $T_i$, the vibration of the membrane 3 due to deformation during discharging is remaining.

The interval time $T_i$ from when outputting of the discharging signal $P_j$ is ended until when outputting of the suppressing signal $P_s$ is started is set in a manner to satisfy the following formula: $T_i=(m-½)\times T_0$ (m: a positive integer), because there is a need for outputting the suppressing signal $P_s$ at a timing to offset the residual vibration of the membrane 3.

Then, when the suppressing signal $P_s$ is output as plotted in FIG. 4, the liquid droplet D is formed when the membrane 3 returns to the original state as illustrated in FIG. 5C and the residual vibration of the membrane 3 is suppressed as well.

The suppressing signal $P_s$ is not particularly limited and may be appropriately selected depending on the intended purpose so long as the suppressing signal $P_s$ is a signal based on the natural vibration period $T_0$ of the membrane 3. Unless the suppressing signal $P_s$ is a signal based on the natural vibration period $T_0$ of the membrane 3, it is difficult to suppress the residual vibration of the membrane 3 with a low energy or to suppress the residual vibration of the membrane 3 in a short time.

The voltage of the suppressing signal $P_s$ is set to lower than or equal to the highest voltage of the discharging signal $P_j$. When the voltage of the suppressing signal $P_s$ is higher than the highest voltage of the discharging signal $P_j$, the suppressing signal $P_s$ may generate unneeded vibration and tend to invite long persistence of the residual vibration.

As described above, in the liquid droplet forming device 1 according to the first embodiment, the voltage signal at the rise of the pulsed driving signal plotted in FIG. 4 is output to the membrane 3 as the discharging signal, and the voltage signal at the fall is output to the membrane 3 the suppressing signal. Further, the discharging signal and the suppressing signal are signals based on the natural vibration period $T_0$ of the membrane 3, the amplitude of the discharging signal is equal or similar to the amplitude of the suppressing signal, and the interval time Ti is set in a manner to satisfy the following formula: $Ti=(m-½)\times T_0$, (m: a positive integer). Hence, by applying the pulsed driving signal plotted in FIG. 4 to the piezoelectric element 4 continuously, the liquid droplet forming device 1 according to the first embodiment can suppress the residual vibration of the membrane 3 quickly without waiting for the residual vibration to decay, and can hence increase the number of times of discharging per unit time. Furthermore, the liquid droplet forming device 1 according to the first embodiment can perform more minute control of the liquid droplet amount because the liquid droplet forming device 1 can reduce occurrence of troubles due to the residual vibration such as a satellite formed when a liquid droplet is split or a mist formed when a liquid droplet scatters minutely.

In the first embodiment, the voltage signal at the rise of the pulsed driving signal plotted in FIG. 4 is the discharging signal, and the voltage signal at the fall is the suppressing signal. However, this is non-limiting. For example, the discharging signal and the suppressing signal may be as plotted in FIG. 6A and FIG. 6B.

Figure 6A:
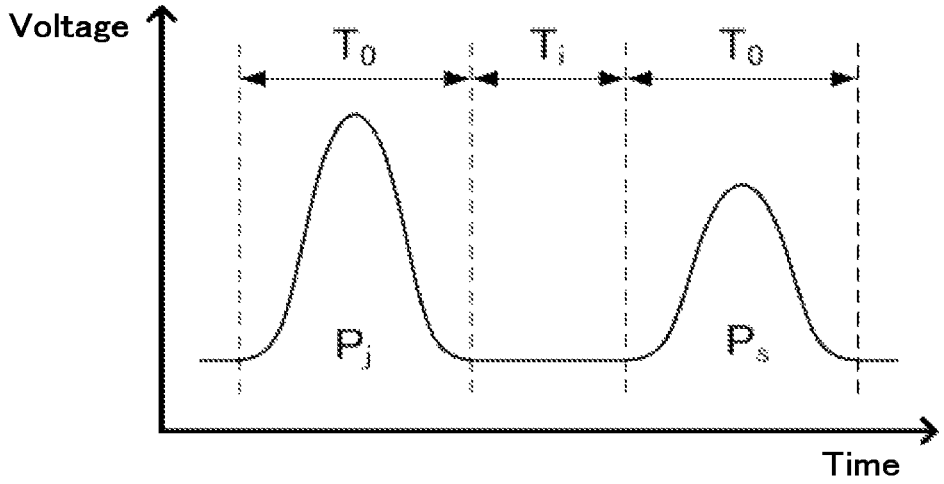
FIG. 6A is graph plotting another example of a discharging signal and a suppressing signal.

As plotted in FIG. 6A, the discharging signal $P_j$ may be, for example, a triangle wave, a sine wave, a rectangular wave, and a triangle wave passed through a low pass filter to have gentle edges. In this case, it is preferable to match the period of, for example, a triangle wave with the natural vibration period $T_0$ of the membrane 3.

The suppressing signal $P_s$ is not particularly limited and may be appropriately selected depending on the intended purpose so long as the suppressing signal $P_s$ is a signal based on the natural vibration period $T_0$ of the membrane 3. The suppressing signal $P_s$ may be, for example, a triangle wave, a sine wave, a rectangular wave, and a triangle wave passed through a low pass filter to have gentle edges. In this case, the period of, for example, a triangle wave is matched with the natural vibration period $T_0$ of the membrane 3.

Figure 6B:
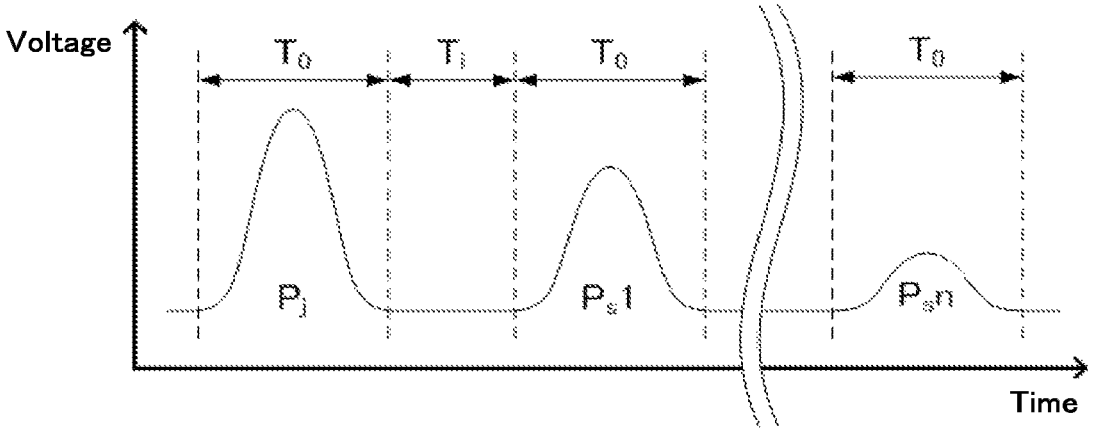
FIG. 6B is a graph plotting another example of a discharging signal and a suppressing signal.

When it is impossible to suppress the residual vibration of the membrane 3 by outputting the suppressing signal $P_s$ only once, the liquid droplet forming device 1 may output a plurality of suppressing signals $P_s$ as plotted in FIG. 6B. Also in this case, the period of, for example, a triangle wave is matched with the natural vibration period $T_0$ of the membrane 3.

Second Embodiment

A liquid droplet forming device according to the second embodiment further includes a liquid amount detecting unit capable of detecting a liquid amount in the liquid chamber 2 in addition to the components of the liquid droplet forming device according to the first embodiment. In the first embodiment, the natural vibration period $T_0$ of the membrane 3 is handled as a fixed value. However, the natural vibration period $T_0$ of the membrane 3 changes depending on the liquid amount in the liquid chamber 2, i.e., the weight of the liquid A contained in the liquid chamber 2. Hence, in the second embodiment, the natural vibration period $T_0$ of the membrane 3 depending on the current liquid amount is obtained based on a detection result of the liquid amount detecting unit. This makes it possible to output a suppressing signal that can better suppress the residual vibration of the membrane 3. Here, the liquid amount detecting unit will be described.

Figure 7:
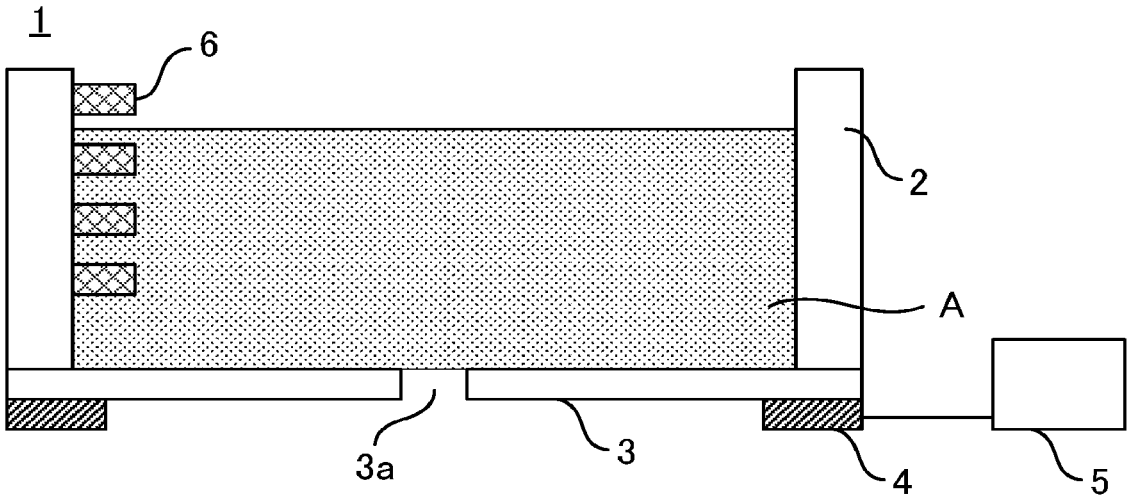
FIG. 7 is a cross-sectional view illustrating a liquid droplet forming device according to a second embodiment.

FIG. 7 is a cross-sectional view illustrating the liquid droplet forming device according to the second embodiment.

As illustrated in FIG. 7, in the second embodiment, a plurality of electrodes 6 are provided on the inner wall surface of the liquid chamber 2 at predetermined intervals in the depth direction in the liquid droplet forming device 1 according to the first embodiment, to configure the liquid amount detecting unit capable of detecting the liquid amount in the liquid chamber 2. In this case, a conductive liquid may be used as the liquid A to be contained in the liquid chamber 2, and, for example, the resistance values between the plurality of electrodes 6 may be measured. This makes it possible to detect the liquid amount in the liquid chamber 2. Then, with reference to a data table generated based on previous measurement of the natural vibration period $T_0$ of the membrane 3 relative to the liquid amount in the liquid chamber 2, it is possible to obtain the natural vibration period $T_0$ of the membrane 3 depending on the liquid amount in the liquid chamber 2.

As described above, by including the liquid amount detecting unit, the liquid droplet forming device 1 according to the second embodiment can obtain the natural vibration period $T_0$ of the membrane 3 depending on the current liquid amount, and can hence output a suppressing signal that can better suppress the residual vibration of the membrane 3.

In the second embodiment, the liquid amount detecting unit is configured by providing the plurality of electrodes 6 on the inner wall surface of the liquid chamber 2 at predetermined intervals in the depth direction as illustrated in FIG. 7. This is non-limiting. For example, a photosensor may be used as the liquid amount detecting unit as illustrated in FIG. 8.

Figure 8:
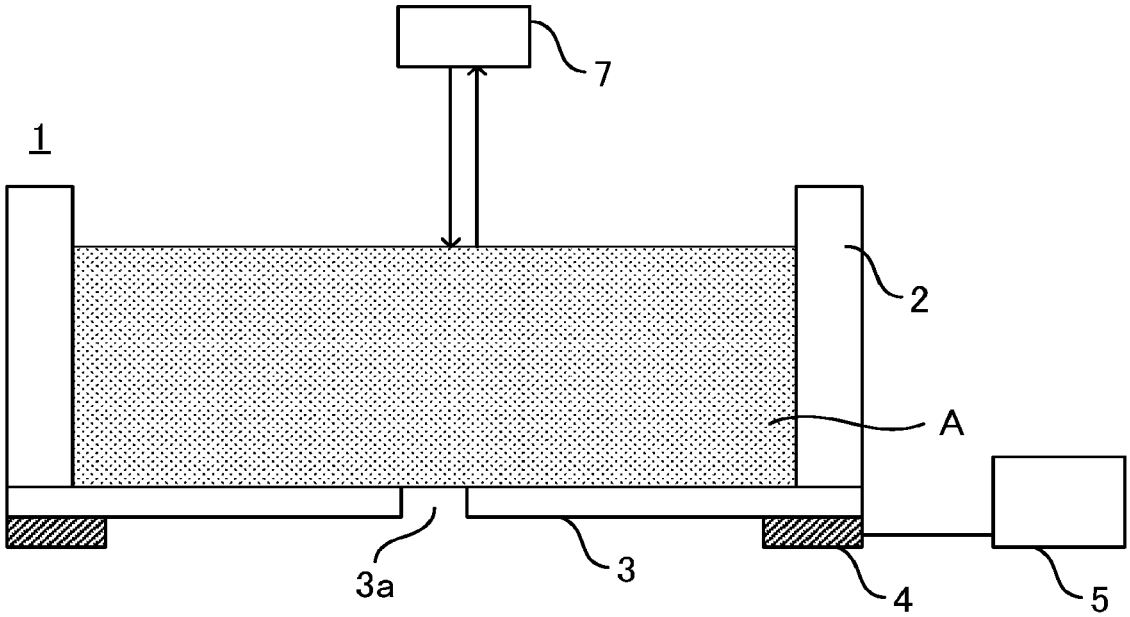
FIG. 8 is a cross-sectional view illustrating a modified example of a liquid droplet forming device according to a second embodiment.

The liquid droplet forming device illustrated in FIG. 8 is provided with a photosensor 7 above the liquid chamber 2.

By emitting light toward the liquid surface in the liquid chamber 2 and receiving reflected light reflected on the liquid surface, the photosensor 7 can measure the distance to the liquid surface based on the phase difference between the emitted light and the reflected light.

The other units are not particularly limited and may be appropriately selected depending on the intended purpose. Preferable examples include a scanning mechanism capable of scanning the liquid droplet forming device triaxially, and a discharging direction adjusting mechanism capable of adjusting the discharging direction triaxially. When the liquid droplet forming device includes the scanning mechanism and the discharging direction adjusting mechanism, there is an advantage that patterning discharging on a planer surface is possible. Further, in this case, there is another advantage that production of a three-dimensional object is possible by patterning discharging performed in a layer laminating manner.

Modified Example of Second Embodiment

Figure 9:
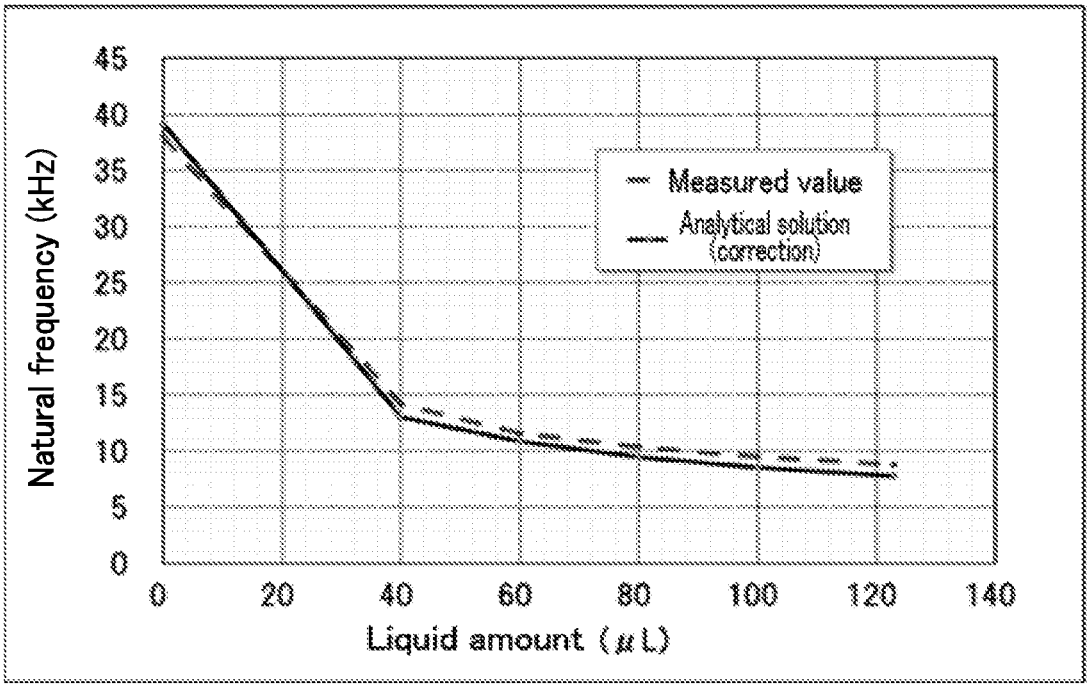
FIG. 9 is a graph plotting an example of a relationship between a liquid amount in a liquid chamber and a natural frequency of a membrane in a liquid droplet forming device according to a modified example of a second embodiment.

FIG. 9 is a graph plotting an example of a relationship between a liquid amount in a liquid chamber and a natural frequency of a membrane in a liquid droplet forming device according to a modified example of a second embodiment. In FIG. 9, the broken line plots measured values and the solid line plots analytical solutions (correction).

As plotted in FIG. 9, in the liquid droplet forming device 1, the natural frequency ($1/T_0$) of the membrane 3 changes in accordance with the liquid amount in the liquid chamber 2, and there is a range in which the natural frequency changes moderately. Therefore, the liquid droplet forming device of the second embodiment is configured to output a discharging signal $P_j$ and a suppressing signal $P_s$ based on a result of detection of the liquid amount in the liquid chamber 2 by a photosensor 7 and form a liquid droplet in a stable state with control of the liquid amount to a predetermined range in which the natural frequency changes moderately.

Figure 10A:
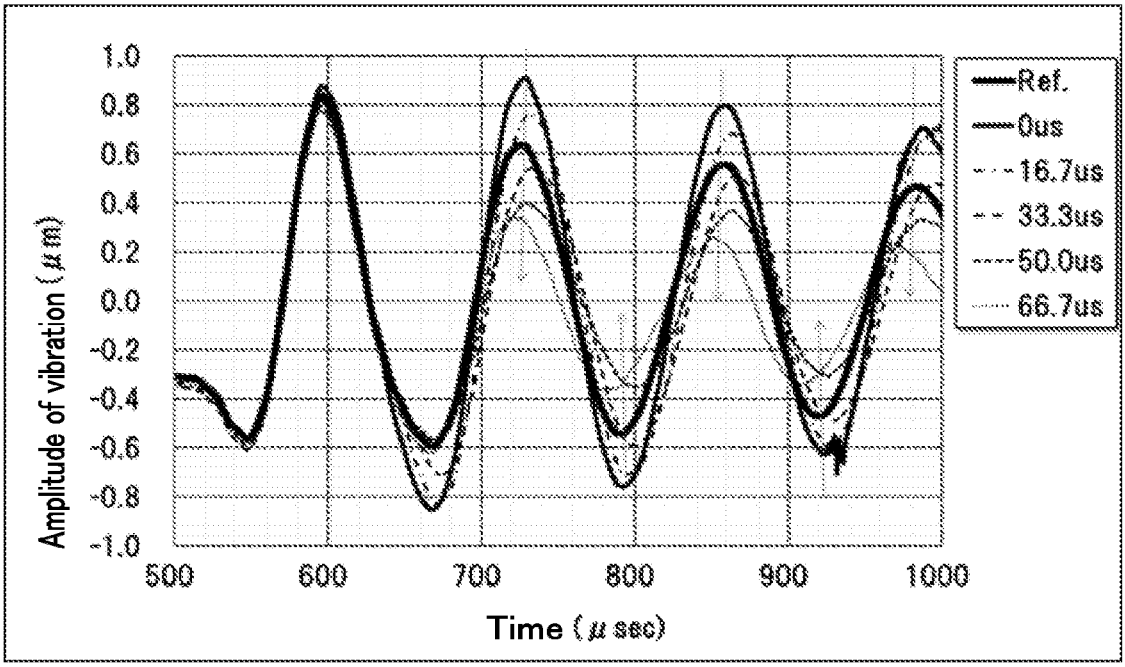
FIG. 10A is a graph plotting an example of a result of measurement of an amplitude of residual vibration of a membrane when an interval time is varied in a liquid droplet forming device according to a modified example of a second embodiment.
Figure 10B:
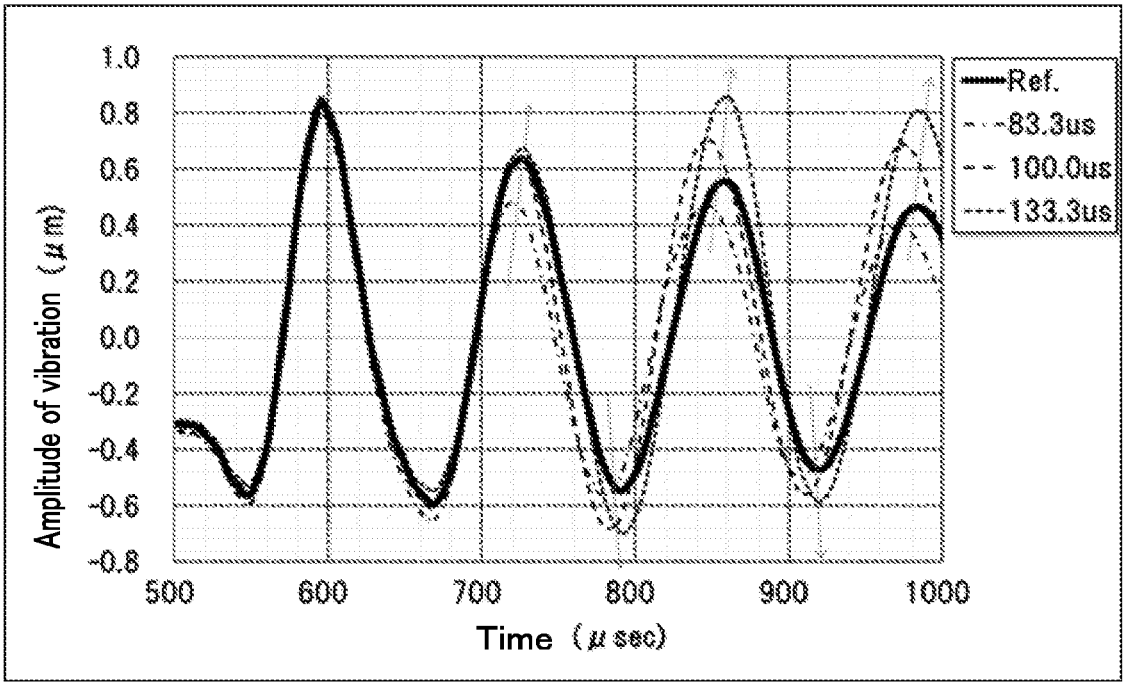
FIG. 10B is a graph plotting an example of a result of measurement of an amplitude of residual vibration of a membrane when an interval time is varied in a liquid droplet forming device according to a modified example of a second embodiment.

FIG. 10A and FIG. 10B are graphs plotting examples of the result of measurement of the amplitude of residual vibration of the membrane when the interval time was varied in the liquid droplet forming device according to the modified example of the second embodiment.

FIG. 10A plots the results when the interval time $T_i$ was set to $0T_o$ through $4/8T_o$ (0.0 microseconds through 66.7 microseconds). In FIG. 10A, the bold line plots the result of a referential example (Ref), the thin line plots the result when the interval time $T_i$ was set to $0T_o$ (0 microseconds), the dashed line plots the result when the interval time $T_i$ was set to $1/8T_o$ (16.7 microseconds), the broken line plots the result when the interval time $T_i$ was set to $2/8T_o$ (33.3 microseconds), the dotted line plots the result when the interval time $T_i$ was set to $3/8T_o$ (50.0 microseconds), and the fine dotted line plots the result when the interval time $T_i$ was set to $4/8T_o$ (66.7 microseconds).

FIG. 10B plots the results when the interval time $T_i$ was set to $5/8T_o$ through $8/8T_o$ (83.3 microseconds through 133.3 microseconds). In FIG. 10B, the bold line plots the result of a referential example (Ref), the dashed line plots the result when the interval time $T_i$ was set to $5/8T_o$ (83.3 microseconds), the broken line plots the result when the interval time $T_i$ was set to $6/8T_o$ (100.0 microseconds), and the dotted line plots the result when the interval time $T_i$ was set to $8/8T_o$ (133.3 microseconds).

The referential examples of FIG. 10A and FIG. 10B plot residual vibration that occurred when a suppressing signal $P_s$ was not output.

The conditions for measuring the residual vibration include measurement of the central portion of the membrane 3 using a laser Doppler vibrometer (LV-1710, available from Ono Sokki Co., Ltd.). In the measurement, the driving unit 5 was caused to output a sine wave having the natural vibration period $T_0$ of the membrane 3 to the piezoelectric element 4 as the discharging signal $P_j$, then vary the interval time $T_i$ as described above, and output the same sine wave as the discharging signal $P_j$ to the piezoelectric element 3 as the suppressing signal $P_s$.

From the results of FIG. 10A and FIG. 10B, it was confirmed that setting the interval time $T_i$ to $2/8T_o$ or longer but $5/8T_o$ or shorter succeeded in suppressing the residual vibration of the membrane 3 better than in the referential example in which the suppressing signal $P_s$ was not applied.

Next, a process of outputting a discharging signal and a suppressing signal based on a result of detection of the liquid amount in the liquid chamber by a photosensor and controlling the liquid amount to a predetermined range in which the natural frequency changes moderately will be described. Here, the flow of this process will be described according to the steps denoted by S in the flowchart illustrated in FIG. 11.

First, the liquid droplet forming device 1 supplies an ink into the liquid chamber 2 (S101) and detects the initial filling amount of the ink in the liquid chamber 2 by the photosensor 7 (S102).

Next, the liquid droplet forming device 1 refers to table data as illustrated in FIG. 12 to obtain the suppressing signal $P_s$, the interval time $T_i$, the discharging signal $P_j$, and the number of times N of repetitive discharging until the next detection of the liquid amount. Further, the liquid droplet forming device 1 calculates the interval time $T_i$ according to the following formula: $T_i=(m-1/2)\times T_0$, and sets these items as the discharging conditions (S103).

In present modified example, the data structure of the table data includes data items "initial filling amount", "optimum natural frequency", "liquid amount range", and "natural frequency range", which are associated with one another. The values in the table data illustrated in FIG. 12 are examples and not relevant to the present modified example.

In the present modified example, the data item "initial filling amount" corresponds to a result of detection of the liquid amount in the liquid chamber by the photosensor after the ink is supplied into the liquid chamber.

In the present modified example, the data item "optimum natural frequency" refers to the optimum natural frequency ($1/T_o$) of the membrane enabling stable formation of a liquid droplet with respect to the liquid amount in the liquid chamber.

In the present modified example, the data item "liquid amount range" refers to a liquid amount range in which application of a suppressing signal $P_s$ results in better suppression of the residual vibration of the membrane than in a referential example.

In the present modified example, the data item "natural frequency range" refers to a natural frequency range of the membrane corresponding to the liquid amount range.

Then, the liquid droplet forming device 1 discharges liquid droplets of the ink N times under the discharging conditions set in S103 (S104 and S105), and determines whether all discharging needs have been fulfilled (S106). When it is determined that all discharging needs have been fulfilled, the liquid droplet forming device 1 terminates the present process. When it is determined that all discharging needs have not been fulfilled, the liquid droplet forming device 1 detects the liquid amount of the ink in the liquid chamber 2 (S107), and supplies the ink into the liquid chamber 2 (S108).

Subsequently, the liquid droplet forming device 1 detects the liquid amount of the ink in the liquid chamber 2 again by the photosensor 7 (S109), and determines whether the liquid amount is the initial filling amount (S110). When it is determined that the liquid amount is the initial filling amount, the liquid droplet forming device 1 returns the process to S104. When it is determined that the liquid amount is not the initial filling amount, the liquid droplet forming device 1 returns the process to S108.

Figure 11:
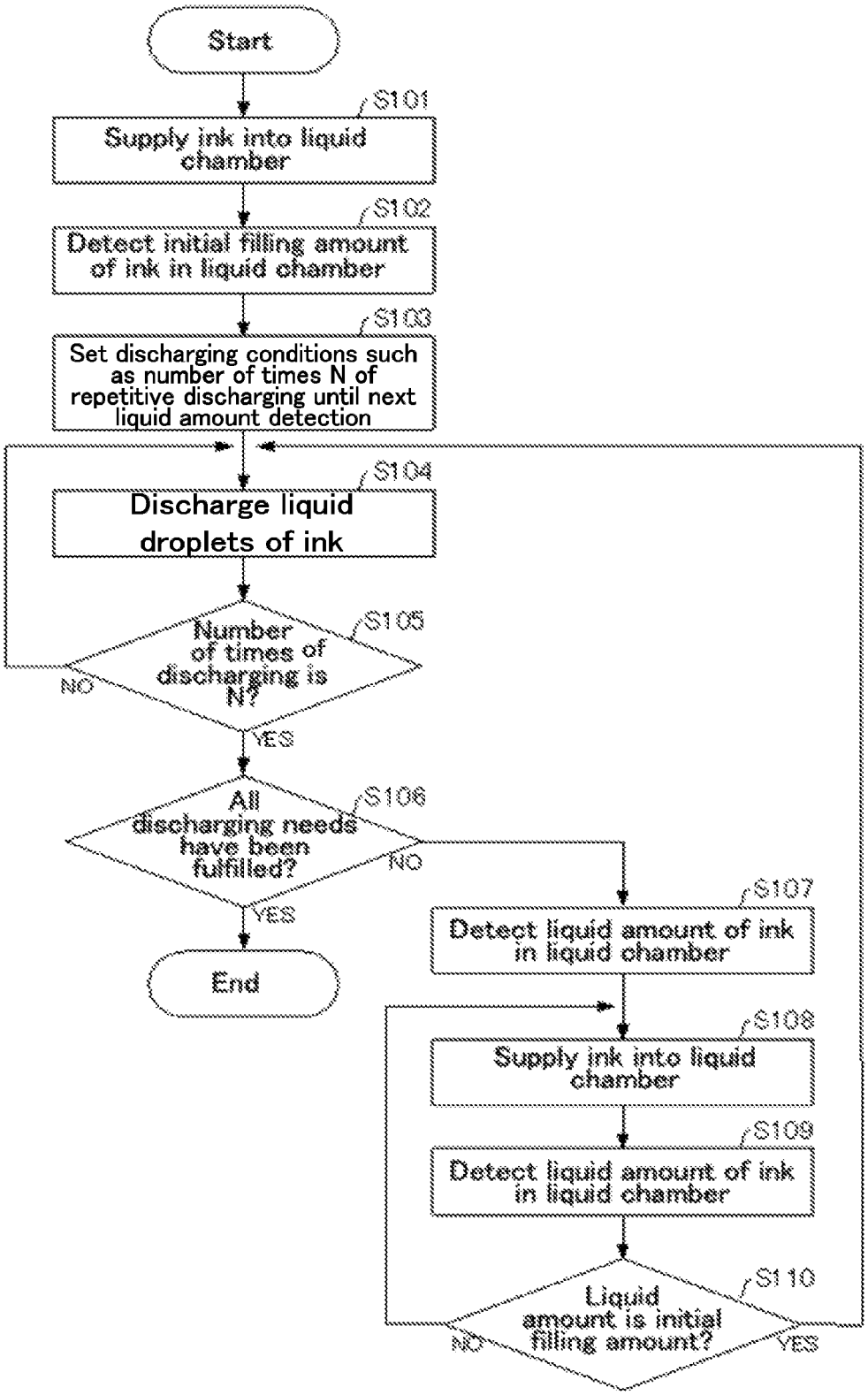
FIG. 11 is a flowchart illustrating an example of a process of stably forming a liquid droplet in accordance with a liquid amount in a liquid chamber in a liquid droplet forming device according to a modified example of a first embodiment.

By performing the process according to the flowchart of FIG. 11 as described above, the liquid droplet forming device 1 of the present modified example can control the liquid amount of the ink in the liquid chamber 2 to an appropriate range even when the liquid amount of the ink fluctuates due to discharging and drying. Further, the liquid droplet forming device 1 of the present modified example can perform stable liquid droplet formation by generating vibration having a high reproducibility with respect to an input signal.

The liquid droplet forming device 1 of the present modified example includes a control unit. The control unit is configured to control the operation of the entire liquid droplet forming device 1 of the present modified example. The control unit is one kind of a processor, and includes a CPU (Central Processing Unit), which is a processing device (hardware) configured to perform various controls and operations. The CPU realizes various functions such as performing the control as illustrated in the flowchart of FIG. 11 by executing an OS (Operating System) and programs stored in, for example, an auxiliary memory device.

As described above, the liquid droplet forming device of the present disclosure includes the liquid container configured to contain a liquid, the membranous member disposed at the bottom of the liquid container and including the discharging hole, the deforming unit configured to deform the membranous member, and the driving unit configured to drive the deforming unit by outputting the discharging signal for deforming the membranous member to discharge the liquid or the suppressing signal for suppressing residual vibration of the membranous member. The suppressing signal is a signal based on the natural vibration period $T_0$ of the membranous member. The amplitude of the suppressing signal is lower than or equal to the amplitude of the discharging signal. The interval time $T_i$ from when outputting of the discharging signal is ended until when outputting of the suppressing signal is started satisfies the following formula: $T_i=(m-½)\times T0$. Hence, the liquid droplet forming device of the present disclosure can quickly suppress residual vibration of the membranous member and can hence increase the number of times of discharging per unit time. Furthermore, the liquid droplet forming device of the present disclosure can perform more minute control of the liquid droplet amount because the liquid droplet forming device of the present disclosure can reduce occurrence of troubles due to residual vibration such as a satellite formed when a liquid droplet is split or a mist formed when a liquid droplet scatters minutely.

Aspects of the present disclosure are, for example, as follows:

<1> A liquid droplet forming device including:

a liquid container configured to contain a liquid;

a membranous member disposed at a bottom of the liquid container and including a discharging hole;

a deforming unit configured to deform the membranous member; and a driving unit configured to drive the deforming unit by outputting a discharging signal for deforming the membranous member to discharge the liquid or a suppressing signal for suppressing residual vibration of the membranous member, wherein the suppressing signal is a signal based on a natural vibration period $T_0$ of the membranous member, wherein an amplitude of the suppressing signal is lower than or equal to an amplitude of the discharging signal, and wherein an interval time $T_i$ from when outputting of the discharging signal is ended until when outputting of the suppressing signal is started satisfies the following formula: $T_i=(m-½)\times T_0$, where m represents a positive integer.

<2> The liquid droplet forming device according to <1>, wherein the driving unit is configured to output a plurality of suppressing signals, each of the plurality of suppressing signals being the suppressing signal.

<3> The liquid droplet forming device according to <1> or <2>, further including a liquid amount detecting unit configured to detect a liquid amount in the liquid container, wherein the driving unit is configured to drive the deforming unit based on a detection result of the liquid amount detecting unit.

<4> A liquid droplet forming method using a liquid droplet forming device that includes:

a liquid container capable of containing a liquid;

a membranous member disposed at a bottom of the liquid container and including a discharging hole;

a deforming unit capable of deforming the membranous member; and a driving unit configured to drive the deforming unit by outputting a discharging signal for deforming the membranous member to discharge the liquid or a suppressing signal for suppressing residual vibration of the membranous member, the liquid droplet forming method including:

containing the liquid in the liquid container; and driving the deforming unit by outputting the discharging signal for deforming the membranous member to discharge the liquid or the suppressing signal for suppressing residual vibration of the membranous member, wherein the suppressing signal is a signal based on a natural vibration period $T_0$ of the membranous member, wherein an amplitude of the suppressing signal is lower than or equal to an amplitude of the discharging signal, and wherein an interval time $T_i$ from when outputting of the discharging signal is ended until when outputting of the suppressing signal is started satisfies the following formula: $T_i=(m-½)\times T_0$, where m represents a positive integer.

<5> The liquid droplet forming method according to <4>, wherein the driving includes outputting a plurality of suppressing signals, each of the plurality of suppressing signals being the suppressing signal.

<6> The liquid droplet forming method according to <4> or <5>, further including detecting a liquid amount in the liquid container, wherein the driving includes driving the deforming unit based on a detection result in the detecting.

The liquid droplet forming device according to any one of <1> to <3> and the liquid droplet forming method according to any one of <4> to <6> can solve the various problems in the related art and achieve the object of the present disclosure.

What is claimed is:

1. A liquid droplet forming device comprising:

a liquid container capable of containing a liquid;

a membranous member that is disposed at a bottom of the liquid container and comprises a discharging hole;

a deforming unit capable of deforming the membranous member; and a driving unit configured to drive the deforming unit by outputting a discharging signal for deforming the membranous member to discharge the liquid or a suppressing signal for suppressing residual vibration of the membranous member, wherein the suppressing signal is a signal based on a natural vibration period $T_0$ of the membranous member, wherein an amplitude of the suppressing signal is lower than or equal to an amplitude of the discharging signal, and wherein an interval time $T_i$ from when outputting of the discharging signal is ended until when outputting of the suppressing signal is started satisfies a formula: $T_i=(m-½)\times T_0$, where m represents a positive integer.

2. The liquid droplet forming device according to claim 1, wherein the driving unit is configured to output a plurality of suppressing signals, each of the plurality of suppressing signals being the suppressing signal.

3. The liquid droplet forming device according to claim 1, further comprising a liquid amount detecting unit configured to detect a liquid amount in the liquid container, wherein the driving unit is configured to drive the deforming unit based on a detection result of the liquid amount detecting unit.

4. A liquid droplet forming method using a liquid droplet forming device that comprises:

a liquid container capable of containing a liquid;

a membranous member that is disposed at a bottom of the liquid container and comprises a discharging hole;

a deforming unit capable of deforming the membranous member; and a driving unit configured to drive the deforming unit by outputting a discharging signal for deforming the membranous member to discharge the liquid or a suppressing signal for suppressing residual vibration of the membranous member, the liquid droplet forming method comprising:

containing the liquid in the liquid container; and driving the deforming unit by outputting the discharging signal for deforming the membranous member to discharge the liquid or the suppressing signal for suppressing residual vibration of the membranous member, wherein the suppressing signal is a signal based on a natural vibration period $T_0$ of the membranous member, wherein an amplitude of the suppressing signal is lower than or equal to an amplitude of the discharging signal, and wherein an interval time $T_i$ from when outputting of the discharging signal is ended until when outputting of the suppressing signal is started satisfies a formula: $T_i=(m-½)\times T_0$, where m represents a positive integer.

5. The liquid droplet forming method according to claim 4, wherein the driving comprises outputting a plurality of suppressing signals, each of the plurality of suppressing signals being the suppressing signal.

6. The liquid droplet forming method according to claim 4, further comprising detecting a liquid amount in the liquid container, wherein the driving comprises driving the deforming unit based on a detection result in the detecting.

* * * * *